US007663430B2

(12) United States Patent
Hung

(10) Patent No.: US 7,663,430 B2
(45) Date of Patent: Feb. 16, 2010

(54) MULTI-LEVEL VOLTAGE SUPPLY CIRCUIT

(75) Inventor: Tsai-Sheng Hung, Hsinchu Hsien (TW)

(73) Assignee: Realtek Semiconductor Corp., Hsinchu (TW)

( * ) Notice: Subject to any disclaimer, the term of this patent is extended or adjusted under 35 U.S.C. 154(b) by 0 days.

(21) Appl. No.: 11/845,531

(22) Filed: Aug. 27, 2007

(65) Prior Publication Data

US 2008/0048752 A1 Feb. 28, 2008

(30) Foreign Application Priority Data

Aug. 28, 2006 (TW) ..... 95131572 A

(51) Int. Cl.
*G05G 1/10* (2006.01)
*G05F 3/02* (2006.01)

(52) U.S. Cl. ..... 327/540; 361/58

(58) Field of Classification Search ..... 327/530
See application file for complete search history.

(56) References Cited

U.S. PATENT DOCUMENTS 4,371,830 A * 2/1983 Loucks ..... 323/265
4,860,148 A * 8/1989 Iwamura et al. ..... 361/58
6,605,964 B2 * 8/2003 Nakada ..... 327/65

* cited by examiner

*Primary Examiner*—Lincoln Donovan
*Assistant Examiner*—Daniel Rojas
(74) *Attorney, Agent, or Firm*—Ladas & Parry LLP

(57) ABSTRACT

In all electronic products, the voltage supply circuit is an essential component for providing a stable supply voltage into the application device. The present invention provides a multi-level voltage supply circuit for solving some problems existing in the application device, in which the multi-level voltage supply circuit includes a first voltage drop component, a second voltage drop component, and a control module. When the first voltage drop component is controlled by the control module in the conducting state, the output voltage is substantially equal to the input voltage minus the first voltage drop. When the first voltage drop component is controlled by the control module in the non-conducting state, the output voltage is substantially equal to the input voltage minus the second voltage drop.

20 Claims, 3 Drawing Sheets

MULTI-LEVEL VOLTAGE SUPPLY CIRCUIT

CROSS-REFERENCE TO RELATED APPLICATION

This application claims priority of Taiwanese Application No. 095131572, filed on Aug. 28, 2006.

BACKGROUND OF THE INVENTION

1. Field of the Invention

The present invention relates to a voltage supply circuit, more particularly to a voltage supply circuit capable of varying a voltage level of an output voltage.

2. Description of the Related Art

It is possible for an integrated circuit (IC) to operate improperly as a result of a large variation in temperature. For example, under normal conditions, an analog voltage of 1.9V may be supplied to an IC so that a certain pin outputs a desired voltage of 0.8V. However, if the integrated circuit is in a location where there are extremely cold temperatures, only 0.35V, for example, may be outputted through this particular pin, and it may not obtain the desired output voltage of 0.8V.

In the conventional circuit capable of solving this problem, a higher voltage level is supplied to the integrated circuit. However, the application of a high voltage comes at the expense of large power consumption and some other side effects in the integrated circuit.

SUMMARY OF THE INVENTION

Therefore, the object of this invention is to provide a voltage supply circuit capable of varying an output voltage level.

According to one aspect, the voltage supply circuit of the present invention comprises a first voltage drop component, a second voltage drop component, and a control module. When the first voltage drop component is controlled by the control module in the conducting state, the output voltage is substantially equal to the input voltage minus the first voltage drop. When the first voltage drop component is controlled by the control module in the non-conducting state, the output voltage is substantially equal to the input voltage minus the second voltage drop.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
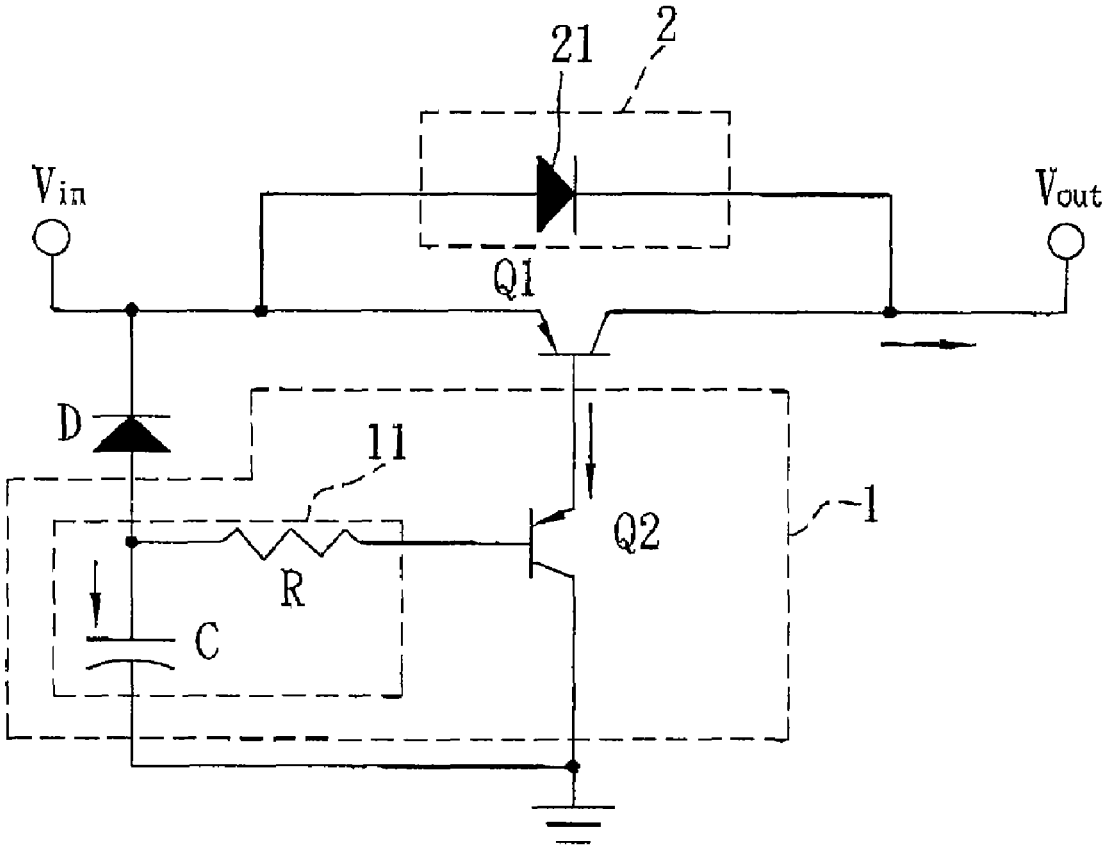
FIG. 1 is a schematic circuit diagram of a voltage supply circuit according to a first preferred embodiment of the present invention.

Before the present invention is described in greater detail, it should be noted that equivalent elements are denoted by the same reference numerals throughout the disclosure.

Referring to FIG. 1, a voltage supply circuit according to a first preferred embodiment of the present invention includes a control module 1, a first transistor (Q1) forming a first voltage-drop component, a forward-biased unit 2 forming a second voltage-drop component, and a diode (D). The control module 1 includes a second transistor (Q2), and a charge unit 11 having a capacitor (C) and a resistor (R). The forward-biased unit 2 has a first terminal and a second terminal, and the first terminal and the second terminal are respectively coupled to an input terminal and an output terminal of the voltage supply circuit. An input voltage (Vin) is applied at the input terminal and an output voltage (Vout) is output at the output terminal.

When a voltage difference between the first and second terminals of the forward-biased unit 2 is greater than a threshold voltage of the forward-biased unit 2, the forward-biased unit 2 is able to conduct current, and a voltage drop is developed across the forward-biased unit 2. In the first preferred embodiment, as shown in FIG. 1, the forward-biased unit 2 includes a diode 21, and the first and second terminals of the forward-biased unit 2 are respectively coupled to an anode and a cathode of the diode 21. In some embodiments, the forward-biased unit 2 of the first preferred embodiment may be realized by serially coupling a plurality of diodes, or may be realized through use of a transistor.

According to the first preferred embodiment, each of the first transistor (Q1) and the second transistor (Q2) is a PNP-type bipolar junction transistor (BJT). Each of the first and second transistors (Q1,Q2) has a first terminal, a second terminal, and a control terminal, in which the first terminal is an emitter, the second terminal is a collector, and the control terminal is a base. The emitter and the collector of the first transistor (Q1) are respectively coupled to the input terminal to which the input voltage (Vin) is applied and the output terminal through which the output voltage (Vout) is output, and the base of the first transistor (Q1) is coupled to the emitter of the second transistor (Q2). The collector of the second transistor (Q2) is coupled to ground, and the base of the second transistor (Q2) is coupled to the resistor (R) of the charge unit 11, which is serially coupled to the capacitor (C) of the charge unit 11. A cathode of the diode (D) is coupled to the input terminal to which the input voltage (Vin) is applied, and an anode of the diode (D) is coupled to a junction between the resistor (R) and the capacitor (C).

In an initial state (t=0) of the voltage supply circuit of the present invention (i.e., start of a first time interval), there is no charge stored in the capacitor (C) and therefore the voltage between capacitor (C) and resistor (R) is substantially equal to zero. At this time, the second transistor (Q2) is controlled to operate in a conducting (or turn-on) state, as is the first transistor (Q1). Further, during the first time interval, a voltage drop ($V_{EC}$ of the first transistor (Q1)) across the diode 21 of the forward-biased unit 2 is insufficient to cause operation of the diode 21 in a conducting state. Since the first transistor (Q1) is controlled to operate in the conducting state by the control module 1, the input voltage (Vin) applied at the input terminal is transmitted to the output terminal through the first transistor (Q1), in which the output voltage (Vout) at this time is substantially equal to the input voltage (Vin). It is to be noted that since there is a small voltage drop ($V_{EC}$) (referred to herein as a conducting voltage) across the emitter and the collector of the first transistor (Q1) when the first transistor (Q1) is made to conduct, in actuality, the output voltage (Vout) at the output terminal is the input voltage (Vin) at the input terminal minus the conducting voltage ($V_{EC}$) when the first transistor (Q2) is controlled to operate in the conducting state.

When the first and second transistors (Q1,Q2) are simultaneously made to conduct, current in the base of the second transistor (Q2) flows to the capacitor (C) of the charge unit 11, such that the capacitor (C) begins to charge. After a period of time, the voltage across the capacitor (C) reaches a predetermined threshold voltage, and it will turn off the first and second transistors (Q1,Q2) to thereby end the first time interval and enter a subsequent second time interval. Hence, the charge unit 11 of the control module 1 causes the second transistor (Q2) to cut off the first transistor (Q1), that is, to control the base of the first transistor (Q1) so that the first transistor (Q1) is controlled to operate in a non-conducting state during the second time interval.

During the second time interval, since the first transistor (Q1) is turned off, output of the output voltage (Vout) is realized by the input voltage (Vin) being transmitted through the diode 21 of the forward-biased unit 2. That is, the voltage drop across the diode 21 becomes sufficient at this time to cause operation of the forward-biased unit 2 in a conducting state. Hence, the output voltage (Vout) becomes the input voltage (Vin) minus the voltage drop across the diode 21 of the forward-biased unit 2. Since the voltage drop across the diode 21 is larger than the voltage drop ($V_{EC}$) across the first transistor (Q1), the output voltage level when the input voltage (Vin) is transmitted via the diode 21 is smaller than the output voltage level when the input voltage (Vin) is transmitted via the first transistor (Q1).

When the power supplied to the voltage supply circuit is turned off, the diode (D) will allow the energy stored in the capacitor (C) to discharge such that when power is supplied to the voltage supply circuit the next time, the voltage supply circuit is able to operate starting from the initial state.

Figure 2:
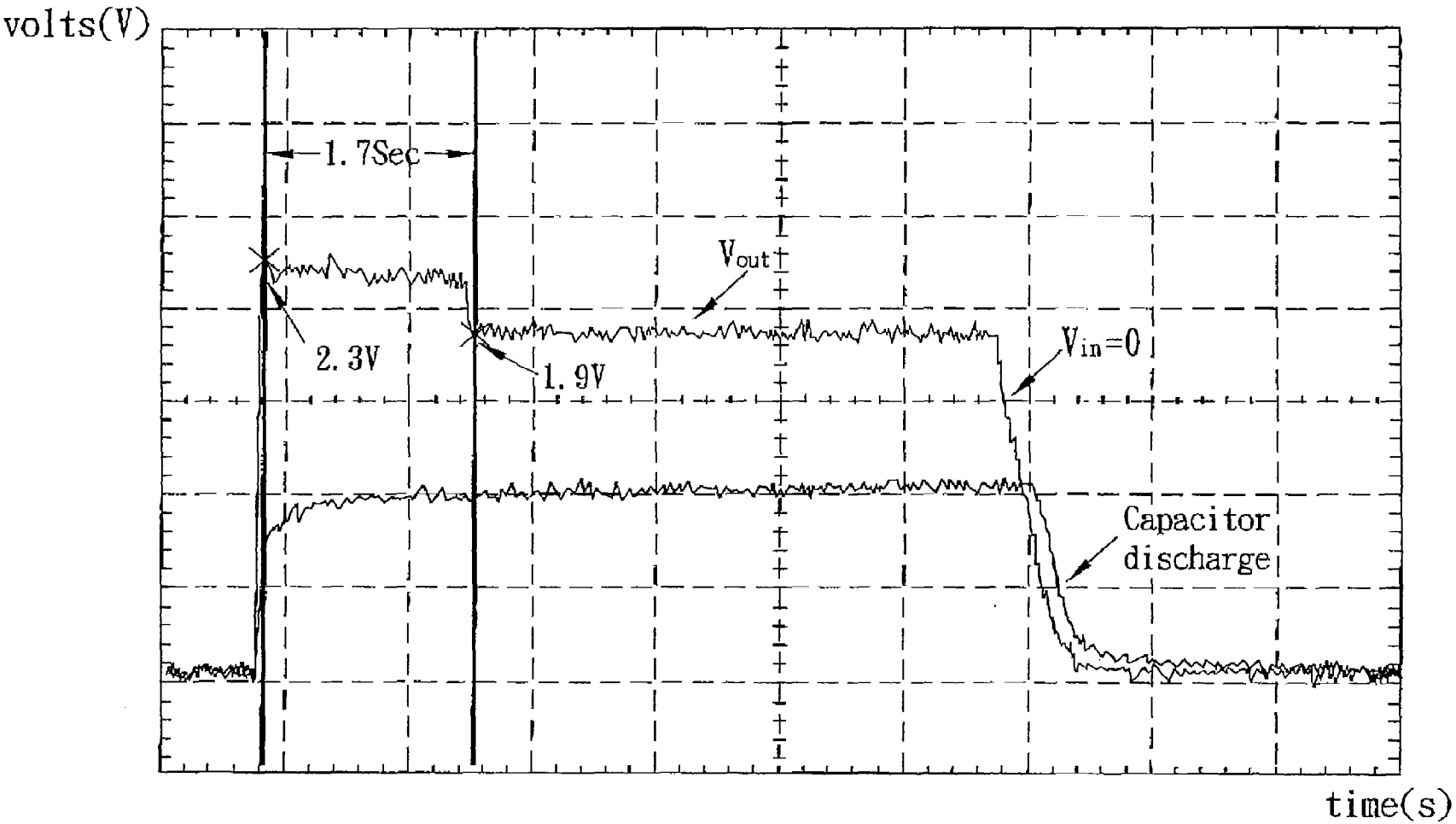
FIG. 2 is a graph illustrating voltage signal waveforms of an output voltage and of a voltage across a capacitor of the voltage supply circuit of the present invention.

FIG. 2 is a graph illustrating voltage signal waveforms of the output voltage (Vout) of the voltage supply circuit and the voltage across the capacitor (C) of the control module 1. As shown in the graph, at an initial state (t=0), there is no energy stored in the capacitor (C) and the voltage across the capacitor (C) is zero. Assuming the input voltage (Vin) is 2.3V, when the first and second transistors (Q1,Q2) are made to conduct, the output voltage (Vout) is substantially equal to $2.3V-V_{EC}$, wherein $V_{EC}$ is the voltage drop across the emitter and the collector of the transistor (Q1). Accordingly, current in the base of the second transistor (Q2) flows to charge the capacitor (C) such that the capacitor (C) begins to store energy. After a period of time (1.7 seconds in this example), the voltage across the capacitor (C) reaches the predetermined threshold voltage such that the second transistor (Q2) is converted to the non-conducting state and further controls the first transistor (Q1) to operate in the non-conducting state. The second time interval is entered at this time. During the second time interval, the output voltage (Vout) is equal to the input voltage (Vin) minus the voltage across the forward-biased unit 2. Assuming that a voltage drop across the forward-biased unit 2 is 0.4V, the output voltage (Vout) is 2.3−0.4=1.9V in this example.

It is to be noted that the forward-biased unit 2 may be selected to have a different voltage drop. As an example, the forward-biased unit 2 may include a plurality of the diodes 21 coupled in series to thereby increase the voltage drop across the forward-biased unit 2 and decrease the second level of the output voltage (Vout). In addition, by changing the values of the resistor (R) and the capacitor (C), the time to charge the charge unit 11 until it arrives at the predetermined threshold voltage may be varied (i.e., the time constant of the RC circuit may be varied) to thereby control the time for the output voltage (Vout) to change from the first level to the second level.

Figure 3:
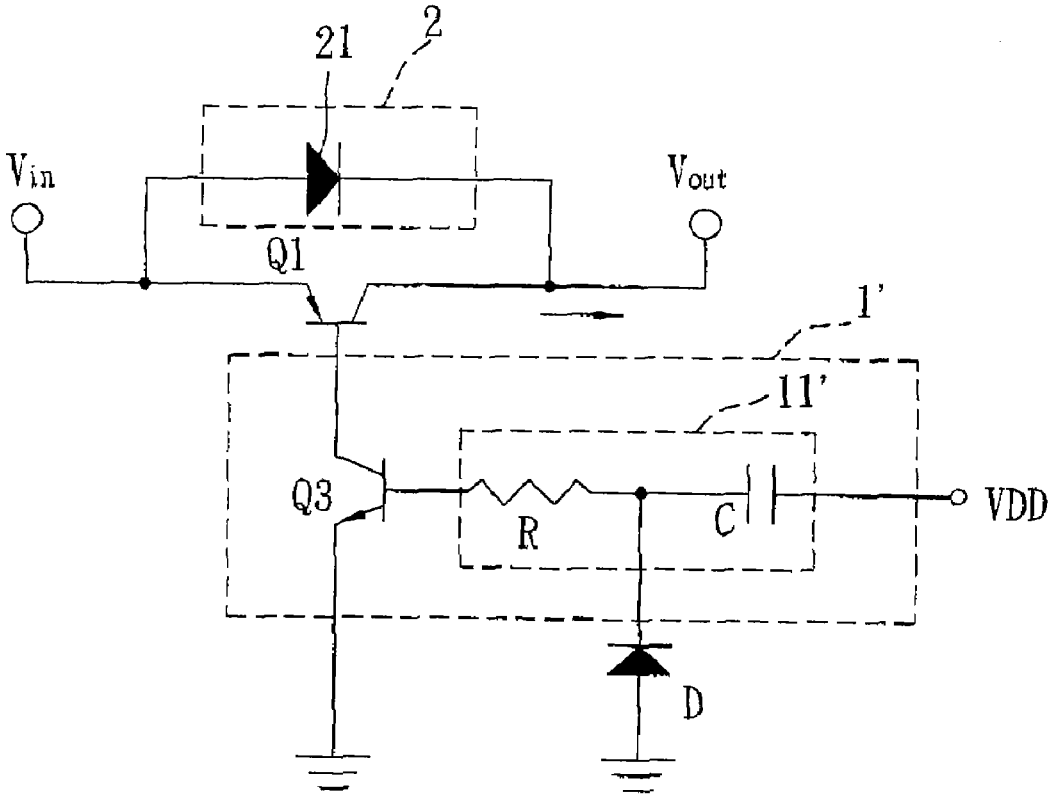
FIG. 3 is a schematic circuit diagram of a voltage supply circuit according to a second preferred embodiment of the present invention.

FIG. 3 illustrates a voltage supply circuit according to a second preferred embodiment of the present invention. It is to be noted that the operation and architecture of the second preferred embodiment are similar to the operation and architecture of the first preferred embodiment. In the second preferred embodiment, the control module 1' includes a third transistor (Q3). Although the charge unit 11' of the control module 1' similarly has the capacitor (C) and the resistor (R), the positioning and coupling of the capacitor (C) and the resistor (R) are altered in this embodiment, which will be described in the following.

The third transistor (Q3) is an NPN-type BJT in the second preferred embodiment, and includes a first terminal, a second terminal, and a control terminal, where the first terminal is a collector, the second terminal is an emitter, and the control terminal is a base. The collector of the third transistor (Q3) is coupled to the base of the first transistor (Q1), and the emitter is coupled to ground. The resistor (R) and the capacitor (C) are coupled in series, the resistor (R) is coupled to the base of the third transistor (Q3), and the capacitor (C) is coupled to an external voltage source (VDD). The anode of the diode (D) is coupled to ground and the cathode is coupled to a junction of the resistor (R) and the capacitor (C). As in the first preferred embodiment, during the first time interval, the third transistor (Q3) is controlled in a conducting state, and the first transistor (Q1) is also controlled in a conducting state. Further, during the first time interval, the diode 21 of the forward-biased unit 2 is in the non-conducting state. The output voltage (Vout) at this time is substantially equal to the input voltage (Vin) minus the voltage drop $V_{EC}$ across the first transistor (Q1).

When the first and third transistors (Q1,Q3) are made to conduct, the capacitor (C) begins to store energy through the current supplied to the base of the third transistor (Q3) by the external voltage source (VDD). When the voltage across the capacitor (C) reaches the predetermined threshold, the first and second transistors (Q1,Q2) will be turned off and the second time interval is entered.

During the second time interval, output of the output voltage (Vout) is realized by the input voltage (Vin) being transmitted through the diode 21 of the forward-biased unit 2. Hence, at this time, the output voltage (Vout) is substantially equal to the input voltage (Vin) minus the voltage drop across the diode 21 of the forward-biased unit 2. When the power (VDD or ground) to the voltage supply circuit is cut off, the diode (D) allows for discharging of the energy stored in the capacitor (C) so that when power is applied to the voltage supply circuit the next time, the voltage supply circuit is able to operate starting from the state of the first time interval.

Figure 4:
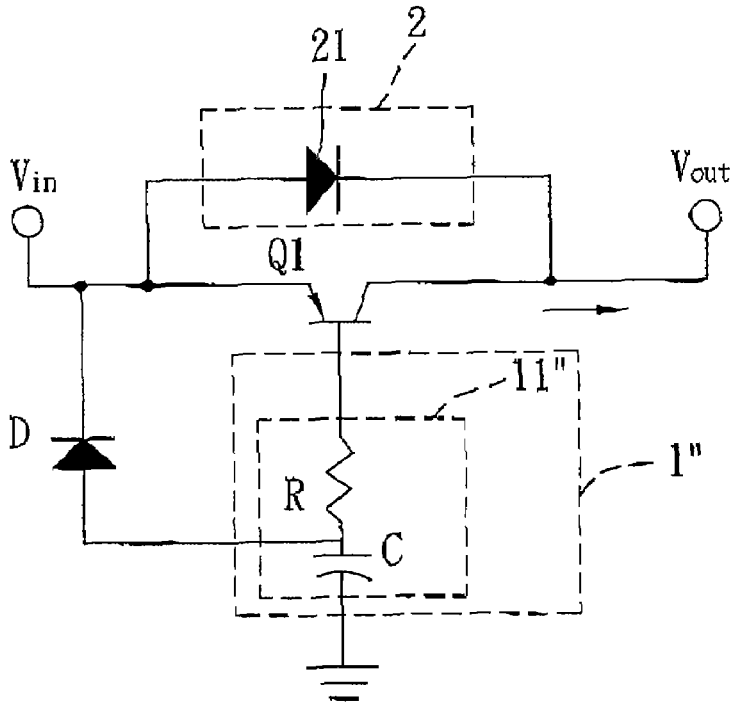
FIG. 4 is a schematic circuit diagram of a voltage supply circuit according to a third preferred embodiment of the present invention.

FIG. 4 illustrates a voltage supply circuit according to a third preferred embodiment of the present invention. It is to be noted that the operation and architecture of the third preferred embodiment are similar to the operation and architecture of the first preferred embodiment. In the third preferred embodiment, the control module 1" includes a resistor (R) and a capacitor (C) which are used to control charge and discharge times so as to further control the first time interval. However, the positioning and coupling of the capacitor (C) and the resistor (R), while not limited to the configuration shown in FIG. 4, are altered in this embodiment.

With reference to FIG. 4, the resistor (R) and the capacitor (C) are coupled in series, and the resistor (R) is further coupled to the base of the first transistor (Q1) and the capacitor (C) is coupled to ground. The cathode of the diode (D) is coupled to the input terminal to which the input voltage (vin) is applied, and the anode of the diode (D) is coupled to a junction of the resistor (R) and the capacitor (C).

Identical to the operation of first preferred embodiment, during the first time interval, the first transistor (Q1) is controlled to operate in the conducting state. Further, during the first time interval, the diode 21 of the forward-biased unit 2 is in the non-conducting state. The output voltage (Vout) at this time is substantially equal to the input voltage (Vin) minus the voltage drop $V_{EC}$ across the first transistor (Q1).

When the first transistor (Q1) is made to conduct, the capacitor (C) begins to store energy by the current through the base of the first transistor (Q1). When the voltage across the capacitor (C) reaches the predetermined threshold, the first transistor (Q1) is turned off and the second time interval is entered.

During the second time interval, output of the output voltage (Vout) is realized by the input voltage (Vin) being transmitted through the diode 21 of the forward-biased unit 2. Hence, the output voltage (Vout) is substantially equal to the input voltage (Vin) minus the voltage drop across the diode 21 of the forward-biased unit 2.

When the power to the voltage supply circuit is cut off, the diode (D) allows for discharging of the energy stored in the capacitor (C) so that when power is applied to the voltage supply circuit the next time, the voltage supply circuit is able to operate starting from the state of the first time interval. It is to be noted that the voltage drop $V_{EC}$ across the first transistor (Q1) is smaller than the voltage drop across the diode 21 in the above embodiments, and therefore the output voltage (Vout) of the output node in the first time interval is larger than the output voltage (Vout) of the output node in the second time interval. However, those skilled in the art could also perform design such that the output voltage (Vout) of the output node in the first time interval is smaller than the output voltage (Vout) of the output node in the second time interval if the voltage drop in the first time interval is larger than the voltage drop in the second time interval. Such a change also falls within the scope of the present invention. Additionally, the voltage supply circuit of the present invention according to one embodiment could be applied in a bandgap voltage generator. In other words, the output voltage of the voltage supply circuit may, for example, be used as a supply voltage of the bandgap voltage generator in an integrated circuit. For electronic products requiring either one supply voltage or a multi-level supply voltage, the voltage supply circuit of the present invention could be used. It is evident from the above description that the voltage supply circuit of the present invention is capable of varying the output voltage level in different time intervals.

While the present invention has been described in connection with what are considered the most practical and preferred embodiments, it is understood that this invention is not limited to the disclosed embodiments but is intended to cover various arrangements included within the spirit and scope of the broadest interpretation so as to encompass all such modifications and equivalent arrangements.

What is claimed is:

1. A voltage supply circuit having an input terminal for receiving an input voltage, and an output terminal for outputting an output voltage, comprising:

a first voltage drop component, coupled between the input terminal and the output terminal, for generating a first voltage drop from the input terminal to the output terminal;

a second voltage drop component, coupled between the input terminal and the output terminal, for generating a second voltage drop from the input terminal to the output terminal; and a control module, coupled to the first voltage drop component, for controlling a conducting state or a non-conducting state of the first voltage drop component;

wherein, when the first voltage drop component is controlled by the control module in the conducting state, the output voltage is substantially equal to the input voltage minus the first voltage drop; when the first voltage drop component is controlled by the control module in the non-conducting state, the output voltage is substantially equal to the input voltage minus the second voltage drop; and the first voltage drop is different from the second voltage drop;

wherein the control module comprises a first capacitor having a first capacitance, and the control module changes the state of the first voltage drop component from the conducting state to the non-conducting state according to a voltage across the first capacitor.

2. The voltage supply circuit of claim 1, wherein the first voltage drop component is a bipolar junction transistor.

3. The voltage supply circuit of claim 2, wherein the bipolar junction transistor is a PNP-type bipolar junction transistor.

4. The voltage supply circuit of claim 2, wherein the first voltage drop is the voltage across the emitter and the collector of the bipolar junction transistor.

5. The voltage supply circuit of claim 2, wherein the second voltage drop component comprises at least one diode.

6. The voltage supply circuit of claim 2, wherein the control module is coupled to the base of the bipolar junction transistor to control the conducting state or the non-conducting state of the bipolar junction transistor.

7. The voltage supply circuit of claim 6, wherein the control module comprises:

a second bipolar junction transistor, coupled to the base of the bipolar junction transistor forming the first voltage drop component; and a charge unit, coupled to the base of the second bipolar junction transistor.

8. The voltage supply circuit of claim 7, wherein the charge unit comprises:

a second capacitor having a second capacitance; and a resistor having a resistance, and coupled between the second capacitor and the base of the bipolar junction transistor forming the first voltage drop component;

wherein a time interval of the conducting state of the bipolar junction transistor forming the first voltage drop component is a function of the second capacitance and the resistance.

9. The voltage supply circuit of claim 8, further comprising:

a diode, coupled to the second capacitor, for allowing an energy stored in the second capacitor to discharge when the voltage supply circuit is turned off.

10. The voltage supply circuit of claim 1, wherein the control module comprises:

a resistor having a resistance and coupled to the first capacitor;

wherein a time interval of the conducting state of the first voltage drop component is a function of the first capacitance and the resistance.

11. The voltage supply circuit of claim 10, wherein when a voltage across the first capacitor is larger than a predetermined threshold voltage, the state of the first voltage drop component is changed from the conducting state to the non-conducting state.

12. The voltage supply circuit of claim 10, further comprising:

a diode, coupled to the first capacitor, for allowing an energy stored in the first capacitor to discharge when the voltage supply circuit is turned off.

13. The voltage supply circuit of claim 1, wherein the second voltage drop component comprises at least one diode.

14. The voltage supply circuit of claim 1, wherein the output voltage is used as a supply voltage of a bandgap voltage generator in an integrated circuit.

15. The voltage supply circuit of claim 1, wherein the first voltage drop is smaller than the second voltage drop.

16. A method of outputting an output voltage, comprising:

providing an input voltage;

generating a first voltage drop by a first voltage drop component;

generating a second voltage drop by a second voltage drop component;

controlling a conducting state or a non-conducting state of the first voltage drop component by a control module; and changing the state of the first voltage drop component from the conducting state to the non-conducting state according to a voltage across a capacitor;

wherein, when the first voltage drop component is controlled by the control module in the conducting state, the output voltage is substantially equal to the input voltage minus the first voltage drop; when the first voltage drop component is controlled by the control module in the non-conducting state, the output voltage is substantially equal to the input voltage minus the second voltage drop; and the first voltage drop is different from the second voltage drop.

17. The method of claim 16, wherein the first voltage drop is smaller than the second voltage drop.

18. The method of claim 16, wherein the first voltage drop component is a bipolar junction transistor.

19. The method of claim 18, wherein the second voltage drop component is a diode.

20. A voltage supply circuit having an input terminal for receiving an input voltage, and an output terminal for outputting an output voltage, comprising:

a first voltage drop component, coupled between the input terminal and the output terminal, for generating a first voltage drop from the input terminal to the output terminal;

a second voltage drop component, coupled between the input terminal and the output terminal, for generating a second voltage drop from the input terminal to the output terminal; and a control module, coupled to the first voltage drop component, for controlling a conducting state or a non-conducting state of the first voltage drop component;

wherein, when the first voltage drop component is controlled by the control module in the conducting state, the output voltage is substantially equal to the input voltage minus the first voltage drop; when the first voltage drop component is controlled by the control module in the non-conducting state, the output voltage is substantially equal to the input voltage minus the second voltage drop; and the first voltage drop is different from the second voltage drop;

wherein the first voltage drop component is a bipolar junction transistor;

wherein the control module is coupled to the base of the bipolar junction transistor to control the conducting state or the non-conducting state of the bipolar junction transistor;

wherein the control module comprises:

a second bipolar junction transistor, coupled to the base of the bipolar junction transistor forming the first voltage drop component; and a charge unit, coupled to the base of the second bipolar junction transistor.

* * * * *